United States Patent [19]

Bowes et al.

[11] Patent Number: 4,486,298

[45] Date of Patent: Dec. 4, 1984

[54] ADSORPTIVE DEMETALATION OF HEAVY PETROLEUM RESIDUA

[75] Inventors: Emmerson Bowes, Woodstown; Susan D. Brandes, Trenton; Malvina Farcasiu; Eric J. Y. Scott, both of Princeton, all of N.J.

[73] Assignee: Mobil Oil Corporation, New York, N.Y.

[21] Appl. No.: 267,307

[22] Filed: May 28, 1981

[51] Int. Cl.[3] ..... C10B 29/04

[52] U.S. Cl. ..... 208/253

[58] Field of Search ..... 208/253

[56] References Cited

U.S. PATENT DOCUMENTS

| | | | |
|---|---|---|---|
| 2,914,458 | 11/1959 | Harper | 208/253 |
| 2,987,407 | 6/1961 | Turken | 208/89 |
| 3,098,816 | 7/1963 | Dean et al. | 208/253 |
| 3,716,479 | 2/1973 | Weisz et al. | 208/251 H |
| 3,766,054 | 10/1973 | Weisz et al. | 208/251 H |
| 3,772,185 | 11/1973 | Chang et al. | 208/253 |
| 3,813,331 | 5/1974 | Weisz et al. | 208/251 H |
| 4,045,331 | 8/1977 | Ward | 208/253 |
| 4,083,924 | 4/1978 | Styring | 208/253 |
| 4,102,779 | 7/1978 | Hensley, Jr. | 208/251 H |
| 4,192,736 | 3/1980 | Kluksdahl | 208/253 |
| 4,222,897 | 9/1980 | Rollmann | 208/253 |

OTHER PUBLICATIONS

Ind. Eng. Chem., Process Des. Develop., vol. 13, No. 3, 1974 "Manganese Nodules as Demetalation Catalysts".

*Primary Examiner*—Carl F. Dees
*Assistant Examiner*—Helane E. Maull
*Attorney, Agent, or Firm*—Alexander J. McKillop; Michael G. Gilman; Howard M. Flournoy

[57] ABSTRACT

A process for the demetalation of hevy petroleum residua is provided wherein said residua dispersed in a suitable solvent is contacted with a large pore solid sorbent whereby organomettalic compounds or complexes contained in said residua are selectively adsorbed by the large pore solid sorbent.

15 Claims, 1 Drawing Figure

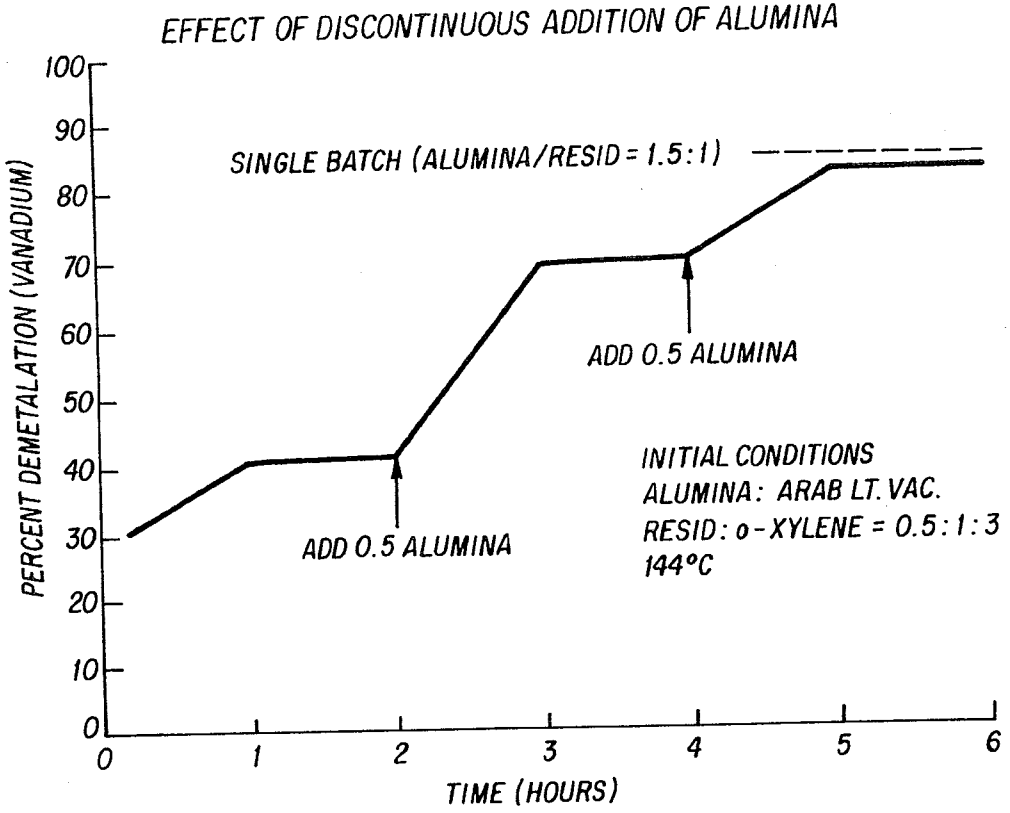
EFFECT OF DISCONTINUOUS ADDITION OF ALUMINA
SINGLE BATCH (ALUMINA/RESID = 1.5:1)
ADD 0.5 ALUMINA
ADD 0.5 ALUMINA
INITIAL CONDITIONS
ALUMINA: ARAB LT. VAC.
RESID: o-XYLENE = 0.5:1:3
144°C
PERCENT DEMETALATION (VANADIUM)
100
90
80
70
60
50
40
30
20
10
0
0
1
2
3
4
5
6
TIME (HOURS)

ADSORPTIVE DEMETALATION OF HEAVY PETROLEUM RESIDUA

BACKGROUND OF THE INVENTION

1. Field of the Invention

This invention relates to the demetalation of heavy petroleum residua. In the novel process disclosed herein heavy petroleum residua is contacted with large pore solid materials adapted to selectively adsorb metal-containing molecules from the residua.

2. Description of the Prior Art

Residual petroleum oil fractions containing relatively high proportions of metals, such as those heavy fractions produced by atmospheric and vacuum crude distillation columns are generally unsuitable as charge stocks for processes such as hydrocracking. Principal metal contaminants are nickel and vanadium compounds, with iron and copper compounds also sometimes present. Additionally, trace amounts of zinc and sodium containing compounds may also be present. These metals, when present in residual oils, are associated with very large hydrocarbon molecules, the metal contaminants are typically large organometallic complexes such as metal porphyrins. The prior art has utilized many methods with varying degrees of success to render such residua suitable for refining processes such as hydrocracking.

Molecules containing metals such as nickel and vanadium which are normally present in heavy resids tend to associate with themselves and with other polyaromatic systems present and form conglomerates which react only with difficulty, therefore, demetalation processes in accordance with the prior art usually involve relatively severe conditions of time and temperature and also usually consume a considerable amount of hydrogen.

SUMMARY OF THE INVENTION

This invention is directed to a process conducted under mild conditions for the removal of metal-containing molecules from petroleum resids. This invention is more particularly directed to a process for the demetalation of heavy petroleum resids dispersed in solvents by selective adsorption on large pore size solids. This invention is also concerned with means for allowing repeated use of the large pore size solids.

BRIEF DESCRIPTION OF THE FIGURE

The FIGURE illustrates the effect on overall demetalation when sorbent is added in stages.

DESCRIPTION OF THE PREFERRED EMBODIMENTS

The process of this invention comprises contacting residual oils dispersed in suitable solvent with solid substrates having an average pore diameter ranging from about 50–100 to about 250–500 Angstroms or more, thereby preferentially removing metal-containing compounds from said residual oil.

The residual oils which may be treated in accordance with this invention are generally any high boiling range residual oil boiling above about 400° F. Such residual oil includes components obtained by, for example, fractionation, such as atmospheric or vacuum crude distillation, of crude oils identified by their source, i.e., Pennsylvania, Midcontinent, Gulf Coast, West Texas, Amal, Agha Jari, Kuwait, Barco and Arabian. The residual oil may comprise a substantial portion thereof of the fractionation product of the above-mentioned crude oils mixed with other oil base stocks.

The solid porous adsorbent material for use herein can include any absorbent material which will significantly reduce the amount of metal containing compounds when contacting residual oil in the absence of added hydrogen at operating temperatures in the range of from about 100°–200° C. and an adsorbent to oil weight ratio of from about 1 to about 0.25 to about 5. The ratio of residual oil to solvent can vary widely. However, it has been shown that this ratio is not particularly critical to the successful operation of the process. The ratio of residual oil to solvent can be from about 1 to 0.5 to 15 or more. Any suitable large pore adsorptive material may be used such as silica, alumina, mixtures of silica and alumina and metallic nodules such as iron or manganese and bi-metallic nodules which are essentially iron/manganese. However, when alumina is used as the sorbent, the specific effective pore size range is narrowed considerably from about 70–180 Angstroms in diameter rather than the previously disclosed range of 50–500 Angstroms.

The operating parameters in the present process are critical to achieving the high degree of demetalation of the residual oil.

The most important parameters in the separation process embodied herein are pore size, degree of activity of the surface of the solid, and the dispersant power of the solvent. The pore size can vary from about 50 to about 1000 Angstroms, and is preferentially from about 100 to 250 Angstroms, however, as stated hereinabove when the adsorbent is alumina the preferred and most effective pore size range is that range where the majority of the pores vary from about 70 to 180 Angstroms in diameter. The temperature preferably varies from about 25° C. to about 400° C. and more preferably from 110° to 150° C. at atmospheric pressure with no hydrogen consumption. The ratio of process materials expressed in terms of resid or feed to sorbent to solvent, preferably is from about 1 to about 0.25 to 4 to about 0.15 to 15.

The solvents useful herein include, for example, aromatic materials such as benzene, toluene, xylene and highly aromatic refinery streams and non-aromatic solvents such as cyclohexane.

Since Ni and V are the most abundant trace metals in petroleum and petroleum resids they are accordingly the chief demetalation concern to the petroleum industry. Their deleterious properties are directly related to their catalytic poisoning effects and to their toxic properties. The chemical nature of Ni-compounds in oils is practically unknown. A portion of the V compounds exist as porphyrin derivatives. It is estimated that no more than one third of the V (and possibly the Ni) is present as porphyrin derivatives.

In vacuum resids the trace metals are mainly associated with "asphaltenes" which precipitate from petroleum in the presence of an aliphatic solvent. In view of the structure of heavy resids and their upgrading it has been found that:

(a) Ni and V in petroleum are associated with polyaromatic compounds including porphyrins. These compounds have the tendency to associate in aliphatic solvents.

(b) an aromatic solvent (benzene, tolueue, xylene) will disperse the polyaromatic compounds in molecular association and can make them more reactive, physically or chemically.

We have found that in the present invention with the use of, for example, o-xylene, the same degree of upgrading of a vacuum resid can be achieved with milder conditions and lower or substantially no hydrogen consumption in contrast to the usual prior art upgrading processes which require severe conditions and consume substantial quantities of hydrogen.

Separation can be used as a preliminary step before catalytic upgrading of a resid and could very likely increase the life of the refining catalyst. For a given adsorbent to resid ratio, close to maximum nickel and vanadium removal is attained at atmospheric pressure, temperatures ranging from about 130°–150° C. and at contact times of less than about three hours.

The effects of time, temperature and pressure on the process disclosed herein are as discussed below. In all cases, the resid was an Arabian Light Vacuum resid containing 70 ppm V and 17 ppm Ni, the solvent was o-xylene and the adsorbent was large pore size alumina in the form of 1/32 inch diameter extrudate.

The ratio of resid to alumina to o-xylene was 1:1:12. The low ratio resid to o-xylene was for experimental convenience. Varying the resid to solvent ratio from 1:1 to about 1:12.5 does not influence the degree of Ni and V removal if all the other experimental conditions remain the same.

Several autoclave (AU) runs were performed under different conditions of temperature, pressure and time. The conditions of the runs and the percent of Ni and V removal are given in Table 1. A detailed balance made for run AU 2 indicated an overall recovery of 96%, i.e., from an initial 25 g of feed, 22 g was recovered as heavy liquid and 2 g was adsorbed by the alumina (by TGA analysis).

At room temperature and pressure and at 305° C. and 2150 psig, the time dependence of Ni and V removal is presented in detail (Tables 3 and 4, respectively).

TABLE 1

CONDITIONS AND RESULTS FOR DEMETALATION RUNS PERFORMED IN AUTOCLAVE*

| Run No. | Temp. (°C.) | Time (hrs.) | Pressure (psig) | % Removal V | % Removal Ni |
|---|---|---|---|---|---|
| AU 1 | 345 | 3 | 2150 | 62 | 62 |
| AU 2 | 345 | 3 | 2670 | 66 | 40 |
| AU 3 | 345 | 6 | 2600 | 78 | 54 |
| AU 4 | 305 | 3 | 2150 | 78 | 66 |
| AU 5 | 143 | 3 | 2150 | 72 | 65 |
| AU 6 | | 19 | 2200 | 72 | 65 |
| AU 7 | 133 | 3 | 0 | 68 | 62 |
| AU 8 | | 19 | 0 | 68 | 62 |
| AU 9 | 28 | 3 | 2150 | 47 | 44 |
| AU 10 | | 21 | 2150 | 62 | 57 |
| Isothermal | 28 | 3 | 0 | 59 | 46 |
| Run** | | 72 | 0 | 66 | 60 |

*All AU runs were performed in the autoclave under nitrogen atmosphere and with a stirring speed of 2500 rpm. Ration resid:alumina:o-xylene, 1 g:1 g:12 ml. Resid-:Arabian Light Vacuum Resid, 17 ppm Ni, 70 ppm V.
**This run was conducted in glass apparatus.

TABLE 2

DEMETALATION AT ROOM TEMPERATURE
Isothermal Experiment
Resid:Alumina:o-xylene: 1 g:1 g:12 ml.

| TIME Min. | % REMOVAL V* | % REMOVAL Ni* |
|---|---|---|
| 0 | 0 | 0 |
| 5 | 34 | 36 |
| 30 | 35 | 35 |

TABLE 2-continued

DEMETALATION AT ROOM TEMPERATURE
Isothermal Experiment
Resid:Alumina:o-xylene: 1 g:1 g:12 ml.

| TIME Min. | % REMOVAL V* | % REMOVAL Ni* |
|---|---|---|
| 60 | 46 | 42 |
| 120 | 53 | 49 |
| 150 | 54 | 49 |
| 180 | 59 | 46 |
| 240 | 55 | 50 |
| 3 days | 66 | 60 |

*Initial resid, 70 ppm V, 17 ppm Ni.

TABLE 3

DEMETALATION AS A FUNCTION OF TIME
(Autoclave Run)
Temperature, 305° C.; 2150 psi

| TIME Min. | % REMOVAL V | % REMOVAL Ni |
|---|---|---|
| 0 | 35 | 37 |
| 43 | 65 | 61 |
| 105 | 72 | 67 |
| 166 | 67 | 63 |
| 223 | 76 | 70 |
| After quenching | 80 | 73 |

Summarizing the above Tables:

1. The adsorption is for all practical purposes at its final value in less than 3 hours for adsorptions performed at 133°–305° C. (Tables 1, 3); at room temperature, the time required to reach the final value is much longer (over 19 hrs.) (Table 2). Longer times at room temperature are likely related to the slower diffusion of the Ni and V compounds.

2. Pressure does not affect the degree of Ni and V removal as shown by the following summary table (Table 4):

TABLE 4

| Run No. | Temp (°C.) | Time (hr.) | Pressure (psig) | % Removal V | % Removal Ni |
|---|---|---|---|---|---|
| AU 7 | 133 | 19 | 0 | 68 | 62 |
| AU 5 | 143 | 19 | 2200 | 72 | 65 |
| AU 1 | 345 | 3 | 2150 | 62 | 62 |
| AU 2 | 345 | 3 | 2670 | 66 | 40 |

Some pressure, of course, will be necessary at temperatures higher than the boiling point of the solvent to keep the solvent in liquid phase.

3. The degree of metal removal increases slightly with increase of temperature from 28° to 305° C. and then decreases as shown by Table 5 below.

TABLE 5

| Run No. | Temperature (°C.) | Final Value % Removal V | Final Value % Removal Ni |
|---|---|---|---|
| — | 28 | 66 | 60 |
| AU 5 | 143 | 72 | 65 |
| AU 4 | 305 (average of 2 values) | 78 | 66 |
| AU average of runs 3, 1 & 2 | 345 (average of 3 values) | 69 | 52 |

The increase can be accounted for by an increased diffusivity, whereas the drop-off at 345° C. may correspond to decreased adsorption at the higher temperature.

4. The results indicate that temperatures of 130°–150° C. and atmospheric pressure are sufficient to achieve close to maximum Ni and V removal for a given ratio of resid to alumina.

The FIGURE graphically illustrates the effects of adding the sorbent to the demetalation process in stages; and as clearly shown, the overall percent demetalation is substantially the same as when the sorbent is added at one time. Vanadium removal is arbitrarily emphasized in the experiments from which the data for the FIGURE was obtained, the initial alumina/resid ratio was 0.5. After equilibrium had been established, a further amount of alumina was added to make the ratio alumina/resid=1. Similarly after a further two hours, an equal aliquot of alumina was added and again refluxing was continued for a further two hours. The extent of demetalation was compared with the corresponding value at equilibrium for alumina/resid=1.5.

ances indicated that 30% of Ni and V on used alumina remained adsorbed on alumina after regeneration with tetrahydrofuran. The data also indicate that solvent regeneration can be achieved at room temperatures.

(2) Thermal regeneration of alumina: All organic material can be removed from used alumina when it is heated at 450° C. in air. For a used alumina which went twice through the sequence:

adsorption of the resid
solvent recovery
thermal recovery

Ni and V contents are lower than 16 ppm Ni and 36 ppm V which constitute the limits of detection of these metals on a solid by the laboratory method used. The calculated values for Ni and V would be in this case 1 ppm Ni and 4 ppm V.

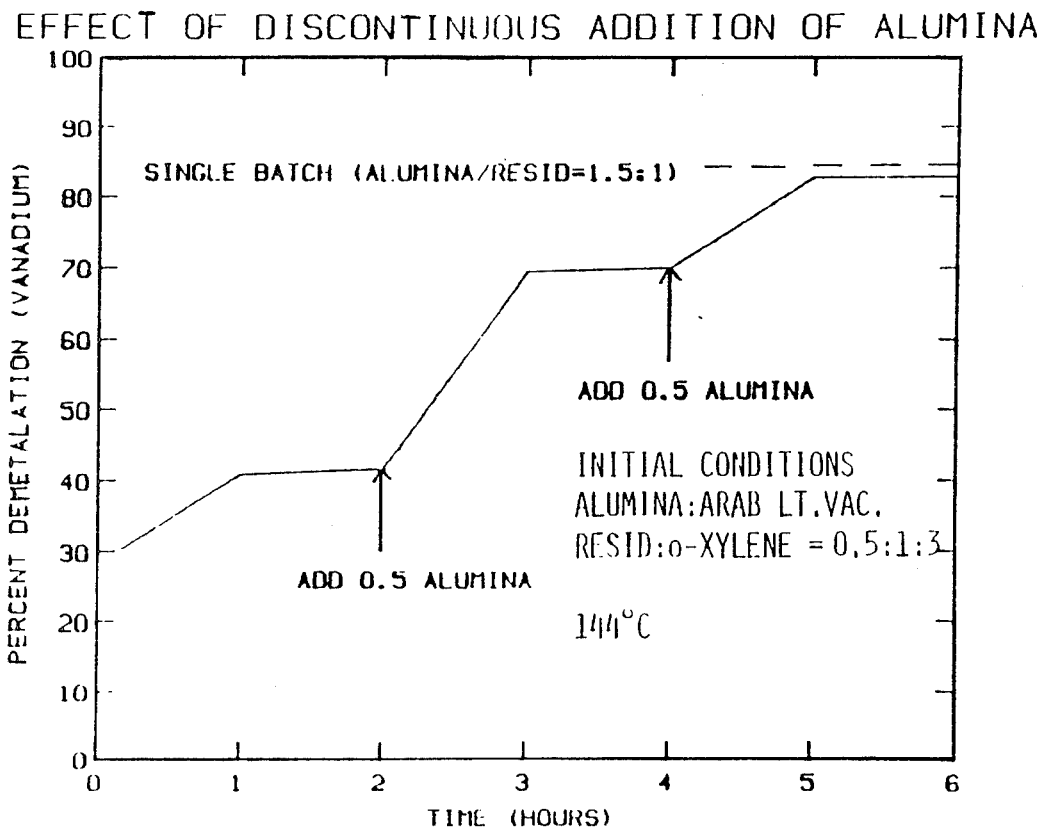

A further aspect of the invention relates to regeneration of the adsorbent material. For any commercially practical use of demetalation by selective adsorption, it is necessary to regenerate the adsorbent, so that it can be used as many times as possible.

The used alumina can be regenerated by: (1) solvent extraction in which case up to 70% of the adsorbed material is removed, or (2) by thermal treatment in air in which all organic matter can theoretically be removed.

(1) Solvent regeneration of used alumina: Used alumina from several demetalation experiments was extracted in a soxhlet apparatus with several solvents. By this procedure 50–70% of the adsorbed organic matter was removed (Table 6). Mass balance was established both by thermogravimetric analysis, in air, of the extracted alumina and by weight of the extract. The two methods gave the same result. As expected, the solvent extracts are enriched in Ni and V as compared with the initial resid; their H content is lower and S and N higher than those of the initial resid (Table 7). Material bal- It should be mentioned that a large pore size CoMo/alumina catalyst containing 27,500 ppm Co and 67,000 ppm Mo is almost as active toward selective adsorption as the corresponding alumina. It is then very likely that thermal regeneration of alumina will restore its initial activity even after adsorbing a large quantity of Ni and V.

Demetalation activity of regenerated alumina: Tetrahydrofuran regenerated alumina and thermally regenerated alumina were found to have the same activity toward selective adsorption as the initial alumina (Table 8). Preliminary results show that room temperature solvent regenerated alumina is about as active as the initial alumina. Accordingly, the adsorbent in accordance with this invention can be regenerated to initial activity by solvent extraction or thermal treatment in air. The solvent extract is enriched in Ni and V compounds as compared with the initial resid. The extract also contains less H or more S and N than the initial resid.

The quantity of organic material adsorbed on alumina (220 Angstroms average pore size sample SMO-9754) was determined by thermogravimetric analysis in air. A well known commercial thermogravimetric analyzer was used in all cases. The solvent extractions were performed in Soxhlet extractors and were continued until the refluxing solution was practically colorless. Ni and V were determined by spectroscopic method in assignee's laboratory. The elemental analyses were performed by an independent commercially available laboratory.

TABLE 6

| Solvent Regeneration of Alumina | | | |
|---|---|---|---|
| Solvent Used for Alumina Extraction | Boiling Point °C. | % Organic* Material Remaining on Alumina | % Organic Material Desorbed (initial 100%) |
| None | — | 8 | 0 |
| Tetrahydrofuran | 66 | 2.4 | 70 |
| $CHCl_3$/13% MeOH | 60 | 2.8 | 65 |
| o-xylene | 144 | 4.0 | 50 |
| anisole | 155 | 3.2 | 60 |

*Weight % of alumina plus organic material

TABLE 7

Elemental Compositions of the Initial Vacuum Resid and of the Solvent Extracts of Used Alumina

| | C | H | N | % S | O | Ni ppm | V ppm |
|---|---|---|---|---|---|---|---|
| Initial resid | 85.1 | 10.4 | 0.27 | 4.0 | 0.5 | 17 | 70 |
| The extract of used alumina (6% of initial resid) | 83.2 | 7.6 | 1.0 | 4.9 | 3.2 | 94 | 448 |
| O—xylene extract (30% of initial resid) | — | — | — | — | — | 28 | 126 |

TABLE 8

Selective Adsorption Activity of Fresh and Regenerated Alumina
Conditions of experiment
Resid:Alumina:o-xylene 1:1:3
6 hrs., 144° C.

| | Ni ppm | V ppm | % demetalation Ni | % demetalation V |
|---|---|---|---|---|
| Initial resid | 17 | 70 | — | — |
| Demetalation on: Fresh alumina | 10 | 32 | 41 | 54 |
| THF regenerated alumina | 8.5 | 32 | 50 | 54 |
| Thermal regenerated alumina | 8.1 | 30 | 55 | 57 |

The following specific examples are detailed with the understanding that they are not limitations on the present invention.

EXAMPLE 1

15.1 g of Arab Light vacuum resid was dissolved in 195 ml of o-xylene, mixed with 15 g of a large pore alumina (average pore size 220 Angstroms) and refluxed overnight. 90% of the resid was recovered. The nickel content was reduced from 17.5 ppm to 9.1 ppm (48% reduction) and vanadium content was reduced from 69.4 ppm to 30 ppm (57% reduction).

EXAMPLE 2

15.0 g of Arab Light vacuum resid was dissolved in 75 ml of o-xylene, mixed with 22.5 g of manganese-iron nodules and refluxed overnight. The nickel content was reduced from 17.5 ppm to 9.4 ppm (46% reduction) and the vanadium content was reduced from 69.9 ppm to 32 ppm (54% reduction).

EXAMPLE 3

15 g of Arab Light vacuum resid, 15 g NaX (pore size less than 10 Angstroms) and 195 ml o-xylene were refluxed overnight. After the removal of the solvent, the Ni and V content in resid was unchanged.

EXAMPLE 4

5 gm of Arab Light vacuum resid, 15 of large pore alumina (average pore size 223 Angstroms) and 15 ml o-xylene were refluxed for one hour. The vanadium content was reduced from 70 ppm to 3.5 ppm (95% devanadation).

Examples 1 and 4 illustrate the invention in general. Example 2 illustrates the specific use of manganese-iron nodules. Example 3 illustrates the unsatisfactory results of using a small pore adsorbent, thereby clearly demonstrating the advantages of the present invention.

EXAMPLE 5

12.5 g Dual pore size distribution alumina (0.82 mole liters per gram pore volume and 0.48 mole liters per gram pore volume in the range of 70–180 Angstroms), 12.5 g Arabian Light vacuum resid in 47.5 ml orthoxylene were refluxed under stirring for approximately 6 hours. The alumina was filtered and the ortho-xylene solvent removed by distillation. Nickel content in the resid was reduced from 17 ppm to 4 ppm (75% removal) and the vanadium content from 70 ppm to 13.6 ppm (80.5% removal).

As noted hereinabove where alumina is concerned the specific pore size diameter range most effective is from about 70 to about 180 Angstroms. Furthermore, for the same concentration of pores in the range of about 70–180 Angstroms a dual pore size distribution alumina, that is aluminas with different pore size distributions, appears to be more active. Alumina extrudates derived from alpha-aluminium monohydrate powder (Ksam, obtained commercially) were used to prepare the duel pore size distribution alumina described in this example. The extrudates were made by calcining Ksam powder (65%) at 1400° F. for 3 hours and then extruding it with 35% Ksam powder. The extrudates were dried and then calcined for three hours at an appropriate temperature.

EXAMPLE 6

10 g atmospheric resid, 10 g large pore size alumina (average pore size diameter 220 Angstroms) and 30 ml cyclohexane were refluxed for about 6 hours. The alumina was filtered and the cyclohexane solvent removed. The nickel content in the resid was reduced from 89 to 36 ppm (59% removal) and the vanadium content from 230 ppm to 150 ppm (33% removal).

Examples 5 and 6 illustrate the narrow range of effective activity when the adsorbent is alumina.

EXAMPLE 7

A solution of resid, solvent and catalyst as described in Example 1 was refluxed overnight under atmospheric pressure. After cooling the solution was filtered through fluted filter paper and the alumina solvent extracted with tetrahydrofuran in a soxhlet apparatus until the refluxing solution was practically colorless. The quantity of organic material removed from the alumina was about 70%.

EXAMPLE 8

Example 7 was repeated except that the alumina was thermally regenerated. The alumina is heated in air at a temperature of about 450° C. until substantially all of the adsorbed material is removed from it.

EXAMPLE 9

Example 8 is repeated and immediately after the solvent regeneration, however, the alumina is thermally treated as in Example 8 and thereafter it is recycled back to a suitable resid processing chamber.

We claim:

1. A method for effecting removal of heavy metal contaminants from petroleum residua consisting essentially of contacting said residua dispersed in a suitable solvent with a solid large pore sorbent wherein said sorbent is selected from the group consisting of alumina, silica, silica-alumina, manganese nodules, iron nodules, manganese/iron nodules and mixtures of any of the above having an effective pore size of about 50 to 1000 Angstroms at atmospheric pressure and a temperature of from about 25° to 400° C. for a time sufficient to remove the major portion of said contaminants therefrom.

2. The method of claim 1 where the temperature is from 110°-150° C.

3. The method of claim 1 where the sorbent is alumina.

4. The method of claim 3 where the majority of the pore diameters of the alumina is from about 70 to about 180 Angstroms.

5. The method of claim 1 where the sorbent is dual pore size distribution alumina.

6. The method of claim 1 where the average pore diameter is from about 100 to 250 Angstroms.

7. The method of claim 6 where the sorbent has an average pore diameter of about 220 Angstroms.

8. The method for effecting removal of heavy metal contaminants from petroleum residua described in claim 1 wherein upon completion of said process the sorbent is recovered, regenerated and recycled for reuse.

9. The method of claim 8 where the sorbent is regenerated thermally or by sorbent extraction with an organic solvent.

10. The method of claim 1 where the metal contaminants are primarily Ni and V organic compounds and/or complexes thereof.

11. The method of claims 1 or 8 where the solvent or solvents are selected from toluene, xylene, benzene, a highly aromatic refinery stream and cyclohexane.

12. The method of claim 1 where the ratio of residua to sorbent to solvent varies from about 1, to about 0.25 to 4, to about 0.5 to 15.

13. A method as described in claim 8 wherein said sorbent is recycled for reuse in a batch process.

14. A method as described in claim 8 wherein said sorbent is recycled for reuse in a continuous process.

15. The method of claim 1 wherein said method is carried out at a temperature of from about 110° to 150° C. at atmospheric pressure.

* * * * *